US012168559B2

(12) United States Patent
Rosenbrien

(10) Patent No.: US 12,168,559 B2
(45) Date of Patent: Dec. 17, 2024

(54) PRODUCT PACKAGING, PACKAGED PRODUCT AND METHOD OF PACKAGING

(71) Applicant: WestRock Shared Services, LLC, Atlanta, GA (US)

(72) Inventor: Cullen B. Rosenbrien, Richmond, VA (US)

(73) Assignee: WestRock Shared Services, LLC, Atlanta, GA (US)

( * ) Notice: Subject to any disclaimer, the term of this patent is extended or adjusted under 35 U.S.C. 154(b) by 8 days.

(21) Appl. No.: 17/715,719

(22) Filed: Apr. 7, 2022

(65) Prior Publication Data

US 2022/0324627 A1 Oct. 13, 2022

Related U.S. Application Data

(60) Provisional application No. 63/171,726, filed on Apr. 7, 2021.

(51) Int. Cl.
*B65D 73/00* (2006.01)
*B65D 61/00* (2006.01)
*B65D 65/46* (2006.01)

(52) U.S. Cl.
CPC ..... *B65D 73/0092* (2013.01); *B65D 61/00* (2013.01); *B65D 65/466* (2013.01); *B65D 2565/382* (2013.01)

(58) Field of Classification Search
CPC .. B65D 61/00; B65D 65/466; B65D 73/0092; B65D 2565/382; B65D 51/18; B65D 51/245; B65D 73/0071
USPC .... 206/217, 232, 461–465, 467, 470, 459.5, 206/806; 215/386, 399
See application file for complete search history.

(56) References Cited

U.S. PATENT DOCUMENTS 3,370,733 A * 2/1968 Giesler ..... B65D 73/0071 206/463
3,408,758 A * 11/1968 Doring ..... B65D 73/0035 40/310
4,083,451 A * 4/1978 Hair ..... B65B 51/14 206/463
4,227,327 A * 10/1980 Thompson ..... G09F 19/02 40/473
4,271,972 A * 6/1981 Thor ..... B65D 55/02 215/253
4,425,090 A 1/1984 Hansen
4,596,110 A 6/1986 Weiler
4,707,966 A 11/1987 Weiler et al.
4,872,551 A 10/1989 Theros
5,362,561 A * 11/1994 Lower ..... B65D 23/12 40/310
5,405,564 A 4/1995 Stepto et al.
6,085,919 A * 7/2000 Singer ..... B65D 81/36 206/217
6,105,342 A 8/2000 Hansen
6,467,617 B1 10/2002 Chen
7,144,632 B2 12/2006 Hayes
7,882,950 B2 2/2011 Nazari
7,967,904 B2 6/2011 Bowden et al.
(Continued)

*Primary Examiner* — Luan K Bui
(74) *Attorney, Agent, or Firm* — Neil G. Cohen; Rohini K. Garg

(57) ABSTRACT

Product packaging includes a blister configured to capture a cap and a portion of a neck of a product container such that a container body of the product container is exterior to the blister and a card coupled to the blister.

15 Claims, 9 Drawing Sheets

(56) References Cited

U.S. PATENT DOCUMENTS

| | | | | |
|---|---|---|---|---|
| 8,151,989 | B2 | 4/2012 | Appelabaum | |
| 8,186,512 | B2 * | 5/2012 | Bertken | B65D 73/005 206/488 |
| 8,524,130 | B2 | 9/2013 | Chindyasov | |
| 9,145,246 | B2 | 9/2015 | Hansen et al. | |
| 9,327,891 | B2 | 5/2016 | Brandow | |
| 9,346,597 | B2 | 5/2016 | Bradfield | |
| 9,403,291 | B2 | 8/2016 | Woerdeman et al. | |
| 9,617,052 | B2 | 4/2017 | McIntire et al. | |
| 9,731,882 | B2 | 8/2017 | Lee et al. | |
| 10,131,475 | B2 | 11/2018 | Babineau | |
| 10,513,063 | B2 | 12/2019 | Woerdeman et al. | |
| 2007/0087212 | A1 | 4/2007 | Iyengar | |
| 2009/0120934 | A1 * | 5/2009 | Domkowski | A61J 1/1425 220/253 |
| 2015/0069064 | A1 * | 3/2015 | Johnson | B65D 43/162 220/324 |
| 2018/0257349 | A1 | 9/2018 | Bhardwaj et al. | |

* cited by examiner

PRODUCT PACKAGING, PACKAGED PRODUCT AND METHOD OF PACKAGING

FIELD

The present disclosure relates to product packaging, packaged products, and methods of packaging product.

BACKGROUND

Manufacturers and retailers of consumer goods typically package their products in various types of display packages. For example, many products are packaged in blister, or clamshell, packages formed by positioning the product within a blister made from various polymeric materials and sealing the blister to enclose the product. However, such blister packages generate undesirable material waste and can be difficult to open. Accordingly, those skilled in the art continue with research and development efforts in the field of product packaging.

SUMMARY

Disclosed are product packaging, packaged product and methods of packaging product. The following is a non-exhaustive list of examples, which may or may not be claimed, of the subject matter according to the present disclosure.

In an example, the disclosed product packaging includes a blister configured to capture a cap and a portion of a neck of a product container and a card coupled to the blister.

In an example, the disclosed packaged product includes a product container and product packaging. The product container includes a body configured to contain product, a neck extending from the body, and a cap removably coupled to the neck. The product packaging includes a blister that captures the cap and a portion of the neck of the product container and a card coupled to the blister.

In an example, the disclosed method of packaging product includes steps of: (1) capturing a cap and a portion of a neck of a product container within a blister body of a blister such that a container body of the product container is exterior to the blister and (2) trap sealing a flange of the blister between a first panel and a second panel of a card.

Other examples of the disclosed product packaging, packaged product and method will become apparent from the following detailed description, the accompanying drawings, and the appended claims.

DETAILED DESCRIPTION

Referring to FIGS. 1-16, by way of examples, the present disclosure is generally directed to product packaging and packaged product. In one or more examples, the product packaging provides a replacement for fully enclosed, trapped blister packaging that reduces the material footprint of the packaging. In one or more examples, the product packaging provides a packaging solution that is more sustainable than packaging made from petroleum-based plastics. In one or more examples, the product packaging provides evidence of and/or resistance to product tampering.

Referring to FIGS. 1-4, which schematically illustrate examples of a packaged product 100. The packaged product 100 includes a product container 102 and product packaging 104. Rather than capturing an entirety of the product container 102, the product packaging 104 captures only a portion of the product container 102, thus reducing the material footprint of the product packaging 104 compared to conventional blister packaging that encloses an entirely of a product or product container.

Figure 2:
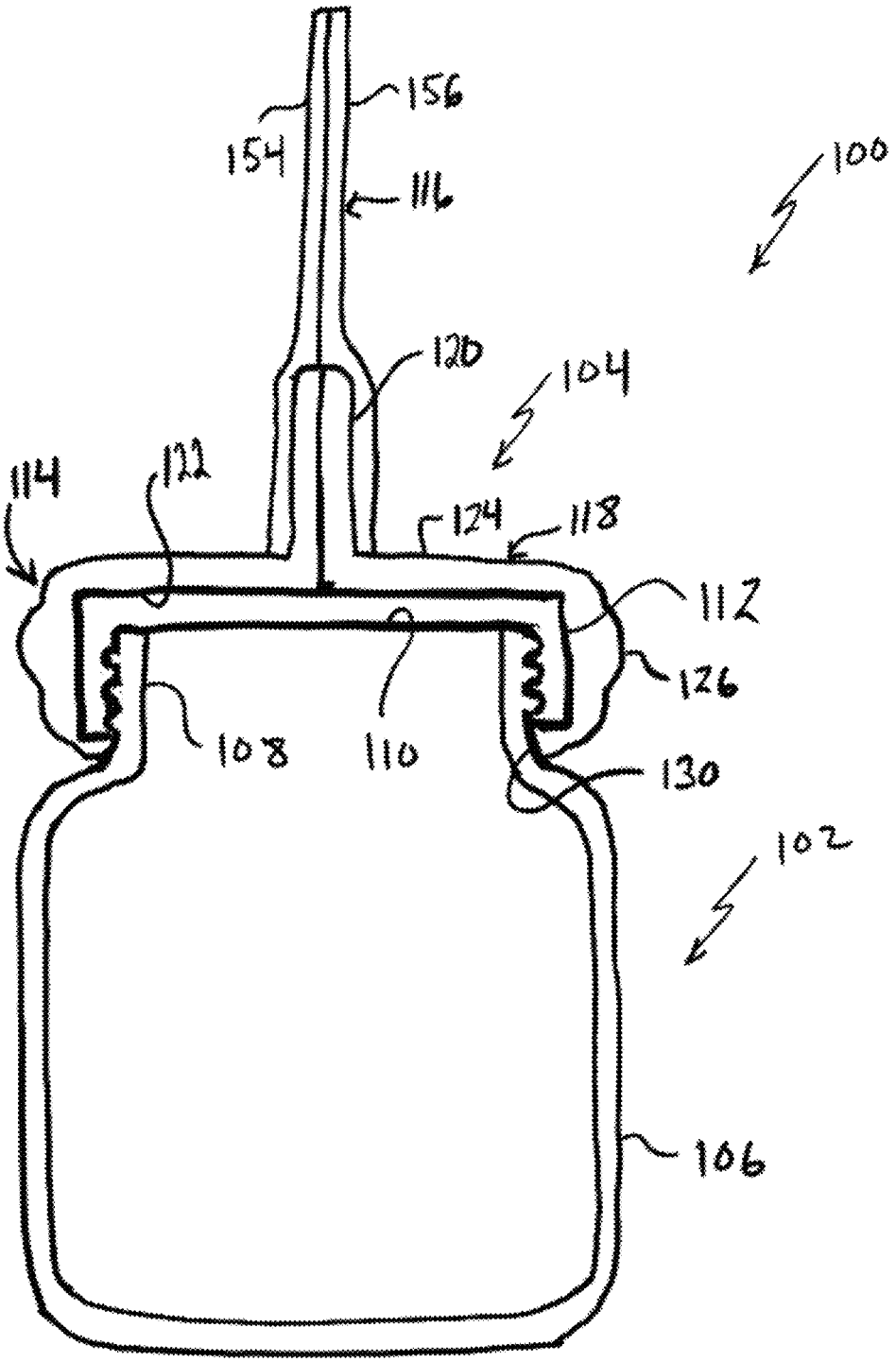
FIG. 2 is a schematic, sectional view of an example of the disclosed packaged product.

In one or more examples, the product container 102 includes a container body 106 (e.g., a bottle) and a neck 108 that extends from the container body 106. The container body 106 forms an internal volume that is configured to receive and contain product. The neck 108 includes an opening 110 (e.g., as shown in FIG. 2) that provides access to the internal volume of the container body 106. The product container 102 also includes a cap 112 (e.g., as shown in FIG. 2). The cap 112 is (e.g., is configured to be) removably coupled to the neck 108 to cover the opening 110 and to enclose the internal volume of the container body 106. The cap 112 may be removably coupled to the neck 108 by any one of various techniques. For example, the cap 112 may include threads on an interior surface that mate with threads on an exterior surface of the neck 108 (e.g., as shown in FIG. 2). Examples of the product may include, but are not limited to, pharmaceuticals, health and beauty products, nutritional supplements, and the like.

In one or more examples, the product packaging 104 includes a blister 114. The blister 114 generally serves as a display housing for the product container 102 (commonly referred to as a blister). The blister 114 captures, surrounds, and/or encloses (e.g., is configured to capture, surround, and/or enclose) the cap 112 and at least a portion of the neck 108 of the product container 102. As such, only the cap 112 and a portion of the neck 108 are captured by and enclosed within the blister 114 and the container body 106 extends from and is located exterior to the blister 114, thus reducing the material footprint of the product packaging 104 compared to conventional fully enclosed blister packaging.

In one or more examples, the blister 114 includes, or is made of or with, a bio-based material. The blister 114 formed of the bio-based material is more sustainable than conventional polymeric blister packaging. The blister 114 formed of the bio-based material is strong, is not prone to mold or pests, and can be readily and inexpensively made. The term "bio-based material" as used herein is meant to include any material that is easily biodegradable such that the blister 114 may degrade under normal environmental conditions. In one or more examples, the bio-based material includes cellulose-based material and starch-based material. Other examples of the bio-based material include, but are not limited to, paper pulp, starch compositions, cellulosic ether, cellulosic fibers, wood fibers, plant starches, flour, gluten meal or feed, plant-based proteins, other suitable natural materials, and combinations thereof. In one or more examples, the bio-based material may also include one or more natural fillers and/or binders.

In one or more examples, the blister 114 is molded. The term "molded" as used herein refers to articles that are shaped directly or indirectly from a material composition using any molding method known in the art. In one or more examples, the blister 114 is injection molded. The term "injection molded" as used herein is meant to include an article made by any suitable injection molding technique. As used herein, "injection molding" refers to a process in which a material composition is mixed and forced into the molding cavity, where it hardens to the configuration of the molding cavity. Any type of injection molding is contemplated, including but not limited to standard injection molding, injection-compression molding, and injection-compression blow molding.

In one or more examples, the blister 114 is molded, such as injection molded, from a moldable (e.g., gelled) mixture of the bio-based material, such as a paper starch solution (e.g., a binding matrix of starch-based materials and cellulose-based materials). Molding temperature should be high enough to cure the bio-based material, but not high enough to degrade the bio-based material inside the mold. Molding temperature is established based on many factors, such as starting material composition, geometry of the blister 114, etc. Generally, the blister 114, formed by molding the bio-based material, may have properties similar to conventional injection molded plastics with regard to hardness, strength, durability, etc.

In other examples, different molding techniques (e.g., die-press molding) may be used to form the blister 114 from the bio-based material. In still other examples, the blister 114 may include, or may be made of or with, a polymeric material or common thermoform plastics, such as polyvinyl chloride (PVC), polyethylene terephthalate (PET), amorphous polyethylene terephthalate (APET), high-density polyethylene (HDPE). In one or more examples, the blister 114 may also include a recycled material, such as recycled polyethylene terephthalate (RPET) or other biodegradable material such as polylactic acid (PLA) and may be formed by any other suitable manufacturing method.

In one or more examples, the blister 114 includes a coating. For example, before, during, or after any of the molding processes, any suitable coating can be applied to a surface of the blister 114 (e.g., in a substantially dry state) for any desired purpose. As examples, the coating can be used to protect the blister 114 from moisture and/or make the blister 114 more waterproof, to make the blister 114 more flexible or less flexible, to provide the blister 114 a smoother, glossier, or protective surface, to reinforce the blister 114, or otherwise alter the surface characteristics of the blister 114.

Referring still to FIGS. 1-4, in one or more examples, the blister 114 includes a blister body 118. The blister body 118 includes, or forms, a container-receiving cavity 122 (e.g., as shown in FIG. 2). The container-receiving cavity 122 receives (e.g., is configured to receive) the cap 112 and a portion of the neck 108 of the product container 102 such that the blister body 118 captures, surrounds, and/or encloses the cap 112 and a portion of the neck 108 of the product container 102.

Figure 3:
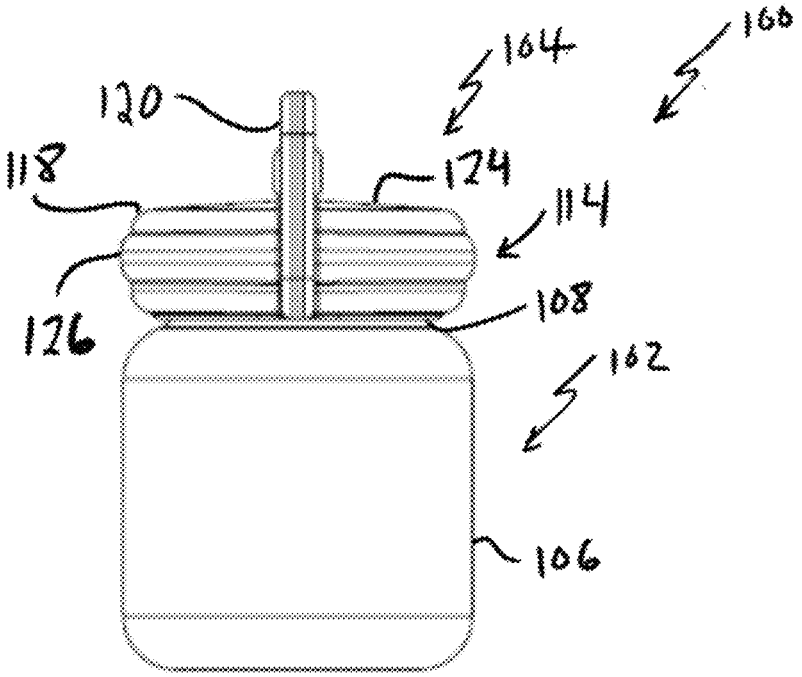
FIG. 3 is a schematic, side view of an example of the product container and a blister of the product packaging positioned on the product container.
Figure 4:
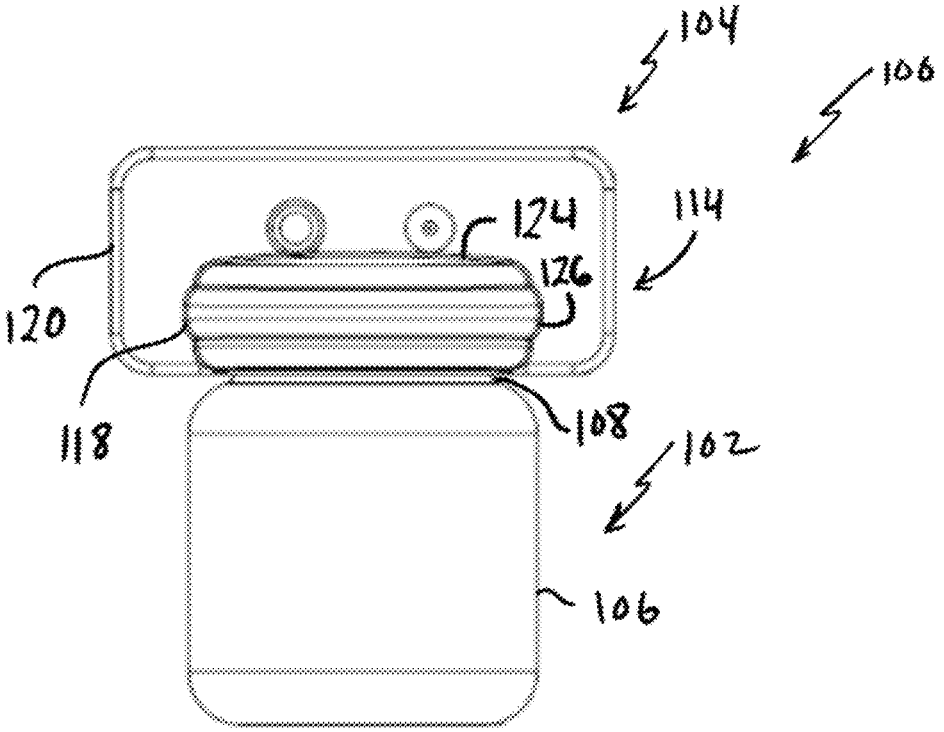
FIG. 4 is a schematic, front view of the example of the product container and the blister shown in FIG. 3.

In one or more examples, the blister 114 includes a flange 120 (e.g., as shown in FIGS. 2-4). The flange 120 extends, at least approximately, perpendicularly outward from the blister body 118. In one or more examples, the flange 120 is located at an approximate middle of the blister body 118 and bisects the blister body 118.

Referring to FIGS. 2-4, in one or more examples, the blister body 118 includes a top wall 124 and a sidewall 126 (e.g., a continuous circumferential sidewall) that extends, at least approximately, perpendicular from the top wall 124. The top wall 124 and the sidewall 126 form the container-receiving cavity 122. The blister body 118 includes a blister opening 130 formed by a lower edge of the sidewall 126, opposite the top wall 124. The blister opening 130 provides access to the container-receiving cavity 122.

In one or more examples, with the cap 112 and a portion of the neck 108 of the product container 102 captured by the blister 114 (e.g., as illustrated in FIG. 2), the top wall 124 of the blister body 118 is located adjacent to and is approximately parallel to a top portion of the cap 112 and the sidewall 126 of the blister body 118 circumscribes (e.g., circumferentially surrounds) a sidewall of the cap 112. In one or more examples, the sidewall 126 of the blister body 118 has a height dimension that is greater than a height dimension of the sidewall of the cap 112 such that a lower end of the sidewall 126 of the blister body 118 extends beyond a lower edge of the sidewall of the cap 112.

In one or more examples, the blister body 118 includes a lip 128. The lip 128 extends radially inward from the lower edge of the sidewall 126 of the blister body 118. In one or more examples, the lip 128 is annular. The lip 128 serves to reduce a diameter of the blister opening 130 that receives and captures the neck 108 of the product container 102 compared to a diameter of the container-receiving cavity 122 that received and encloses the cap 112. In one or more examples, with the cap 112 and a portion of the neck 108 of the product container 102 captured by the blister 114 (e.g., as illustrated in FIG. 2), the lip 128 surrounds (e.g., overlaps) the lower edge of the cap 112 and extends toward the neck 108 of the product container 102. In one or more examples, an internal diameter of the lip 128 (e.g., the diameter of the blister opening 130) is less that an outer diameter of a portion of the neck 108 of the product container 102, such as the thread on the neck 108 or a rim of the neck 108. As such, the cap 112 cannot be removed from the neck 108 without damaging the blister body 118, thereby providing evidence and/or resistance to product tampering.

As best illustrated in FIGS. 3 and 4, in one or more examples, a first portion of the flange 120 extends outward, at least approximately perpendicular, from the top wall 124 of the blister body 118. A second portion of the flange 120 extends outward, at least approximately perpendicular, from the sidewall 126. A third portion of the flange 120 extends outward, at least approximately perpendicular, from the sidewall 126, diametrically opposite to the second portion of the flange 120.

Referring again to FIGS. 1 and 2, in one or more examples, the product packaging 104 includes a card 116. The card 116 generally serves as a product display for the product container 102 (commonly referred to as a blister card). The card 116 is coupled to the blister 114. In one or more examples, the card 116 engages and is coupled to the flange 120 of the blister 114. In one or more examples, a hang hole may be formed in or through the card 116.

In one or more examples, the card 116 is formed from a sheet material. In one or more examples, the card 116 is made of paperboard, cardboard, corrugated paperboard, or other suitable paper-based material. In one or more examples, the card 116 is made of a tear-resistant material or includes a tear-resistant feature. In one or more examples, the card 116 is made of Natralock® paperboard, commercially available from WestRock of Georgia, USA.

In one or more examples, the card 116 is sealed (e.g., is configured to be sealed) to the flange 120 of the blister 114. Methods and/or techniques used to seal the card 116 to the flange 120 of the blister 114 include, but are not limited to, using an adhesive or directly sealing with heat and pressure, infrared, ultrasonic, ultraviolet and radio frequency.

Figure 1:
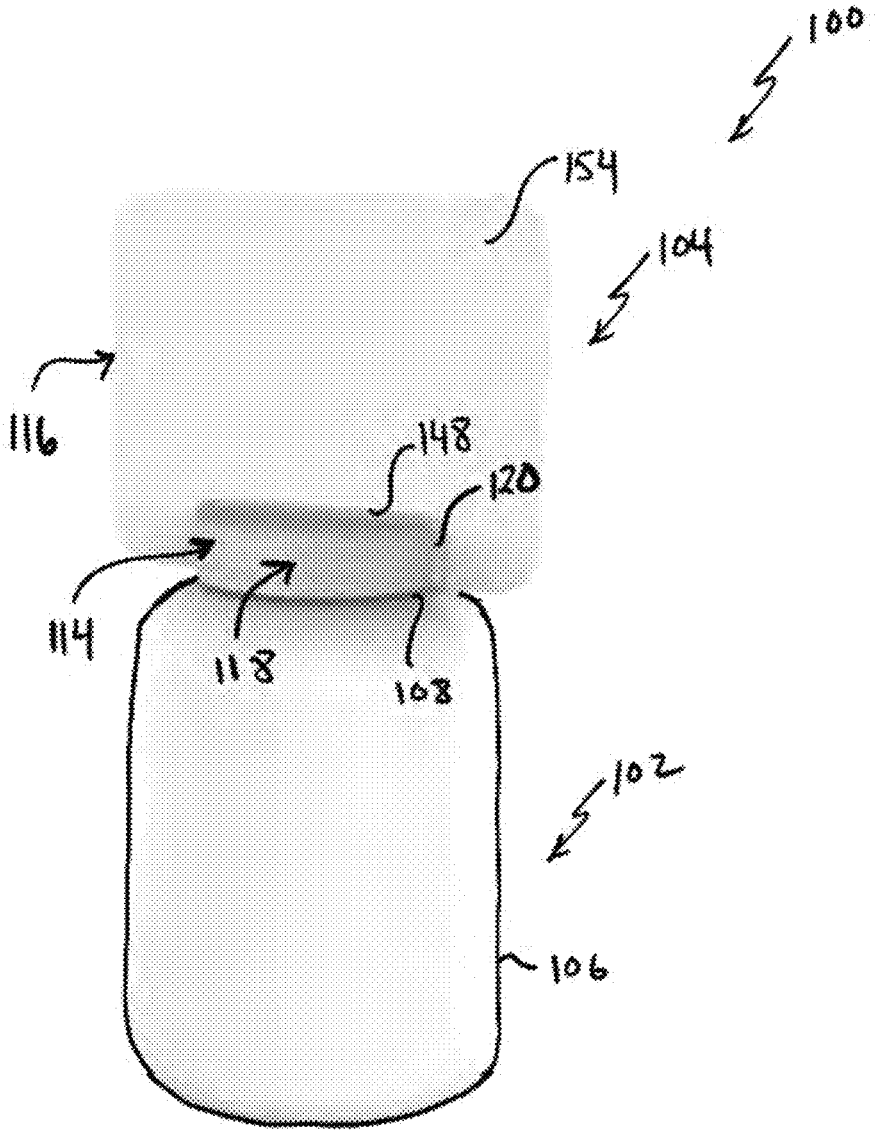
FIG. 1 is a schematic illustration of an example of a packaged product that includes a product container and product packaging.

Referring to FIG. 1, in one or more examples, the card 116 includes a card opening 148. The card opening 148 is suitably sized to receive the blister body 118 of the blister 114, such that the blister body 118 fits within and extends outward through the card opening 148. Generally, the flange 120 of the blister 114 is sized larger than the card opening 148, thereby enabling the card 116 to be coupled to the flange 120.

Figure 5:
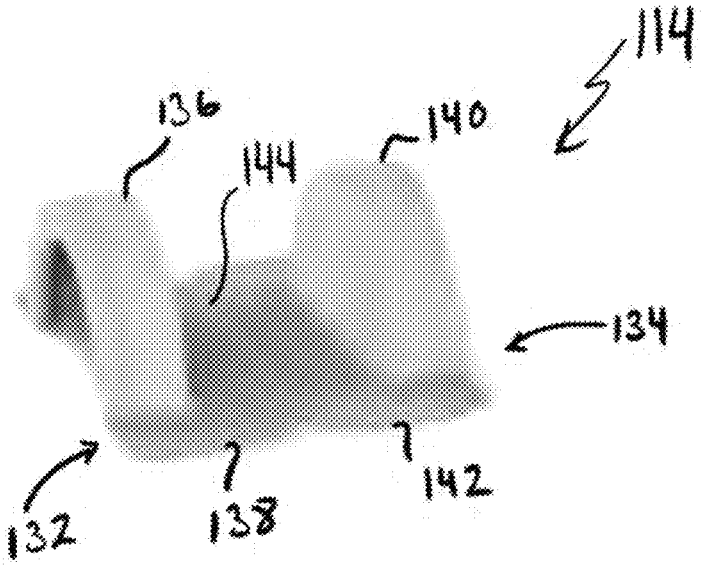
FIG. 5 is a schematic, perspective view of an example of the blister of the product packaging.
Figure 6:
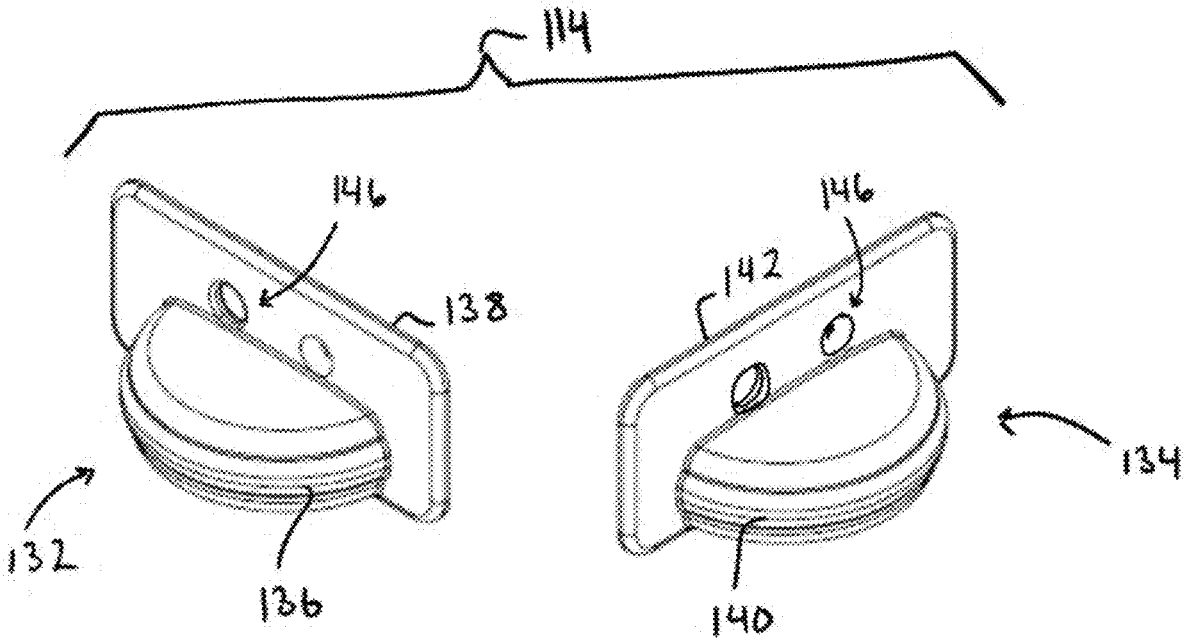
FIG. 6 is a schematic, perspective view of an example of the blister of the product packaging.

Referring now to FIGS. 5 and 6, which schematically illustrate examples of the blister 114. In one or more examples, the blister 114 includes a first blister-portion 132 and a second blister-portion 134. In one or more examples, the first blister-portion 132 and the second blister-portion 134 are aligned and mated (e.g., are configured to be aligned and mated) with each other such that, in combination, they form the blister body 118 and the flange 120 (e.g., as shown in FIGS. 1-4). The first blister-portion 132 captures (e.g., is configured to capture) a first portion of the cap 112 and a first portion of the neck 108 of the product container 102. The second blister-portion 134 captures (e.g., is configured to capture) a second portion of the cap 112 and a second portion of the neck 108 of the product container 102.

In one or more examples, the first blister-portion 132 and the second blister-portion 134 are identical to or are mirror images of each other. As such, in one or more examples, the first blister-portion 132 forms a first half of the blister 114 and the second blister-portion 134 forms a second half of the blister 114. In one or more example, the first blister-portion 132 includes a first blister-body-portion 136 (e.g., a first half of the blister body 118) and a first flange-portion 138 (e.g., a first half of the flange 120). In one or more example, the second blister-portion 134 includes a second blister-body-portion 140 (e.g., a second half of the blister body 118) and a second flange-portion 142 (e.g., a second half of the flange 120).

In one or more examples, with the first blister-portion 132 and the second blister-portion 134 mated to each other and the cap 112 and a portion of the neck 108 of the product container 102 captured by the blister 114 (e.g., as illustrated in FIGS. 2-4), the first blister-body-portion 136 and the second blister-body-portion 140, in combination, form the blister body 118 and the first flange-portion 138 and the second flange-portion 142, in combination, form the flange 120.

As illustrated in FIG. 5, in one or more examples, the first blister-portion 132 and the second blister-portion 134 form a unity body (e.g., are molded as a single unit). For example, the first blister-portion 132 and the second blister-portion 134 are directly coupled to each other along a living hinge 144 (e.g., a thin flexible hinge made from the same material as the first blister-portion 132 and the second blister-portion 134) along an interface between the first flange-portion 138 and the second flange-portion 142. In these examples, during assembly of the product packaging 104, the first blister-portion 132 and the second blister-portion 134 are folded about the living hinge 144 relative to each other such that the cap 112 and a portion of the neck 108 of the product container 102 are captured by the blister body 118 of the blister 114.

As illustrated in FIG. 5, in one or more examples, the first blister-portion 132 and the second blister-portion 134 form discrete bodies (e.g., are molded as a distinct units). In these examples, during assembly of the product packaging 104, the first blister-portion 132 and the second blister-portion 134 are positioned relative to each other such that the cap 112 and a portion of the neck 108 of the product container 102 are captured by the blister body 118 of the blister 114.

In one or more examples, each one of the first blister-portion 132 and the second blister-portion 134 includes a retention feature 146. The retention feature 146 at least temporarily secures (e.g., is configured to at least temporarily secure) the first blister-portion 132 and the second blister-portion 134 together once aligned and mated such that the cap 112 and a portion of the neck 108 of the product container 102 are captured by the blister 114.

In one or more examples, the first blister-portion 132 includes a first retention feature 146 located on the first flange-portion 138 and the second blister-portion 134 includes a second retention feature 146 located on the second flange-portion 142. The retention feature 146 may be any one of various types of interlocking features. In one or more examples, the retention feature 146 includes at least one of male portion (e.g., a tab) and a female portion (e.g., an aperture). With the first blister-portion 132 and the second blister-portion 134 properly aligned, the male portion of the retention feature 146 of one of the first blister-portion 132 and the second blister-portion 134 mates and interlocks (e.g., via friction fit) with the female portion of the retention feature 146 of the other one of the first blister-portion 132 and the second blister-portion 134 to, at least temporarily, hold the first blister-portion 132 and the second blister-portion 134 together such that the cap 112 and a portion of the neck 108 of the product container 102 are captured between the first blister-body-portion 136 of the first blister-portion 132 and the second blister-body-portion 140 of the second blister-portion 134.

In one or more examples, the first blister-portion 132 and the second blister-portion 134 are sealed or otherwise coupled (e.g., are configured to be sealed or otherwise coupled) to each other around the cap 112 and a portion of the neck 108 of the product container 102. In one or more examples, the first flange-portion 138 and the second flange-portion 142 are sealed or otherwise coupled (e.g., are configured to be sealed or otherwise coupled) to each other. Methods and/or techniques used to couple or seal the first flange-portion 138 and the second flange-portion 142 together include, but are not limited to, using an adhesive or directly sealing with heat and pressure, infrared, ultrasonic, ultraviolet and radio frequency.

Referring again to FIGS. 1 and 2, in one or more examples, the card 116 includes a first panel 154 and a second panel 156 that is opposite to the first panel 154. The first panel 154 and the second panel 156 are coupled together such that the flange 120 of the blister 114 is sandwiched and trapped between the first panel 154 and the second panel 156 of the card 116 and the blister body 118 of the blister 114 extends out of the card opening 148 in the card 116. In one or more examples, the first blister-portion 132 and the second blister-portion 134 are sealed (e.g., are configured to be sealed) to each other around the cap 112 and a portion of the neck 108 of the product container 102 using the card 116. For example, with the first blister-portion 132 and the second blister-portion 134 properly aligned and the cap 112 and a portion of the neck 108 of the product container 102 captured between the first blister-body-portion 136 and the second blister-body-portion 140, the first flange-portion 138 and the second flange-portion 142 are trap sealed between the first panel 154 and the second panel 156 of the card 116. Methods and/or techniques used to seal the card 116 to itself (e.g., to seal the first panel 154 and the second panel 156 together) and/or to seal the card 116 to the flange 120 (e.g., to seal the first panel 154 to the first flange-portion 138 and to seal the second panel 156 to the second flange-portion 142) include, but are not limited to, using an adhesive or directly sealing with heat and pressure, infrared, ultrasonic, ultraviolet and radio frequency.

Referring generally to FIGS. 1 and 2 and particularly to FIGS. 7-10, which schematically illustrate examples of a blank 150 used to form the card 116. As illustrated in FIGS. 7-10, the blank 150 may have any one of various configurations depending on the configuration of the card 116 and/or the process used to assemble the product packaging 104. Generally, the blank 150 has an interior surface (e.g., visible in FIGS. 7-10) that defines an interior surface of the card 116, which further forms a coupling or sealing surface of the card 116. The blank 150 also has an exterior surface (e.g., hidden in FIGS. 7-10), opposite the interior surface, that defines an exterior surface of the card 116 (e.g., as shown in FIGS. 1 and 2), which further forms a display surface of the card 116.

Figure 8:
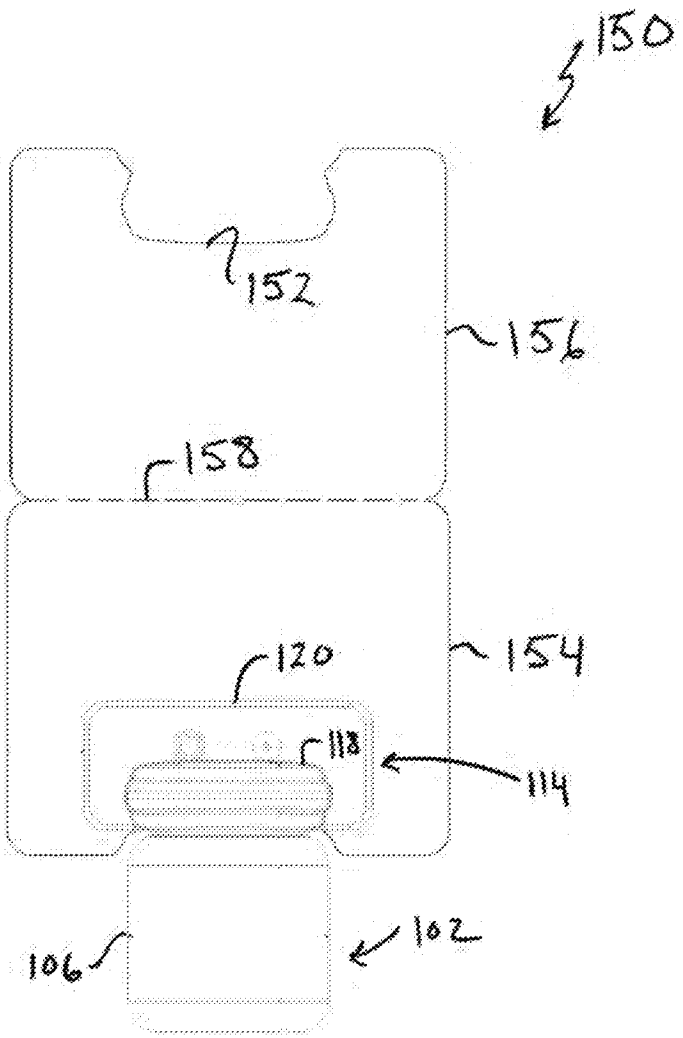
FIG. 8 is a schematic, plan view of an example of the blank shown in FIG. 7 positioned relative to the blister of the product packaging.
Figure 7:
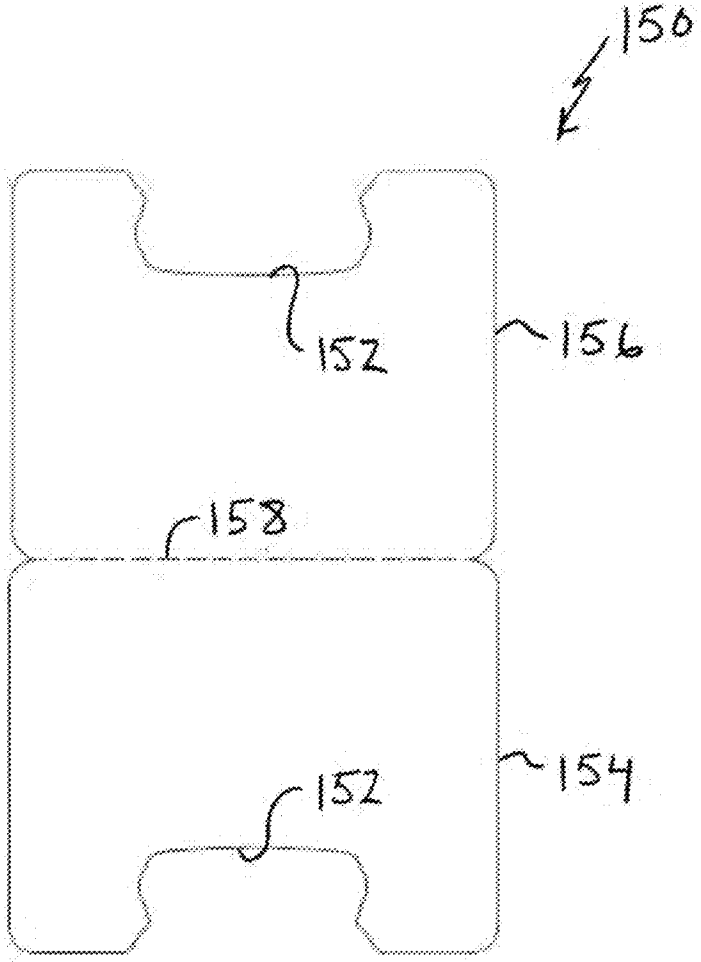
FIG. 7 is a schematic, plan view of an example of a blank used to form a card of the product packaging.
Figure 13:
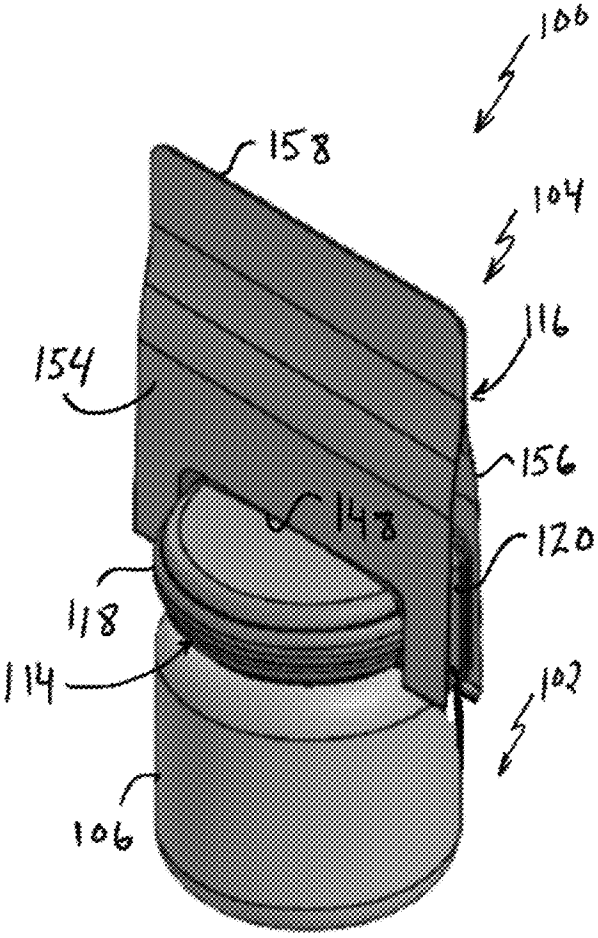
FIG. 13 is a schematic illustration of an example of the card, formed from the blank shown in FIG. 7, coupled to the blister during assembly of the packaged product.

Referring to FIGS. 7,8 and 13, in one or more examples, the blank 150 includes the first panel 154 and the second panel 156 connected to the first panel 154 along a fold line 158, which may be generally straight. In one or more examples, each one of the first panel 154 and the second panel 156 includes a cutout 152. The cutouts 152 receive (e.g., are configured to receive) the blister body 118. The cutouts 152 are suitably sized to receive the blister body 118 of the blister 114, such that the blister body 118 fits within and extends outward through the cutouts 152 and the flange 120 of the blister 114 is sized larger than the cutout 152, thereby enabling the first panel 154 and the second panel 156 to be coupled to the flange 120 to from the card 116 (e.g., as shown in FIGS. 8 and 13). In one or more examples, the cutout 152 in the first panel 154 is formed along an edge of the first panel 154 opposite the fold line 158 and the cutout 152 in the second panel 156 is formed along an edge of the second panel 156 opposite the fold line 158. In one or more examples, during assembly of the product packaging 104, the blank 150 is folded over about the fold line 158 and sealed to itself (e.g., the first panel 154 and the second panel 156 are sealed together) such that the flange 120 of the blister 114 is trapped and sealed between the first panel 154 and the second panel 156 and the blister body 118 of the blister 114 extends out of the card opening 148 (e.g., as shown in FIG. 13).

Figure 9:
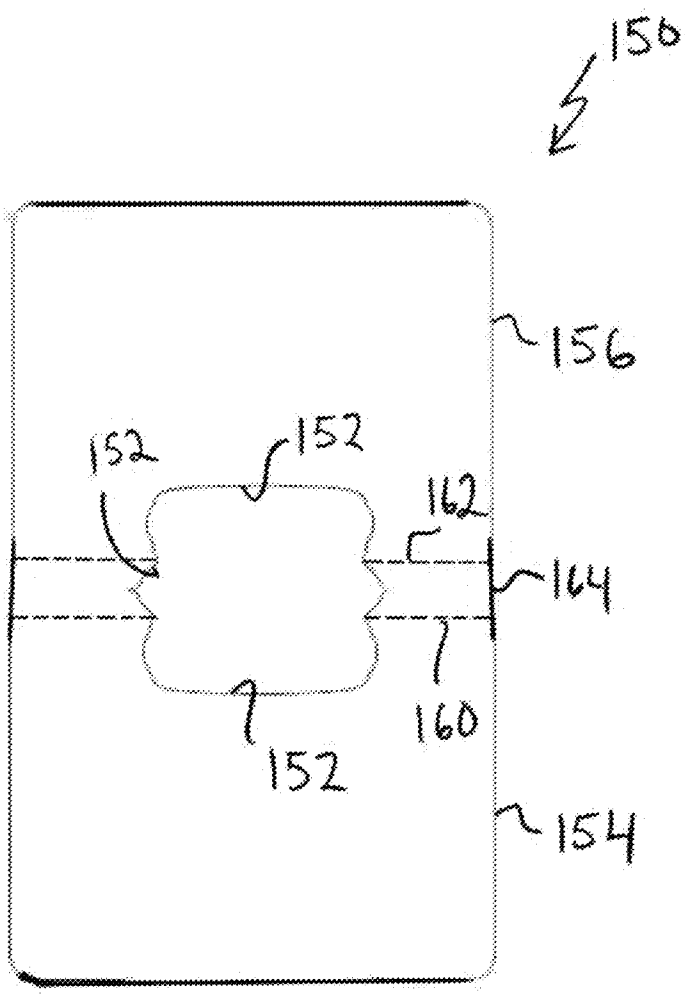
FIG. 9 is a schematic, plan view of an example of the blank used to form the card of the product packaging.
Figure 14:
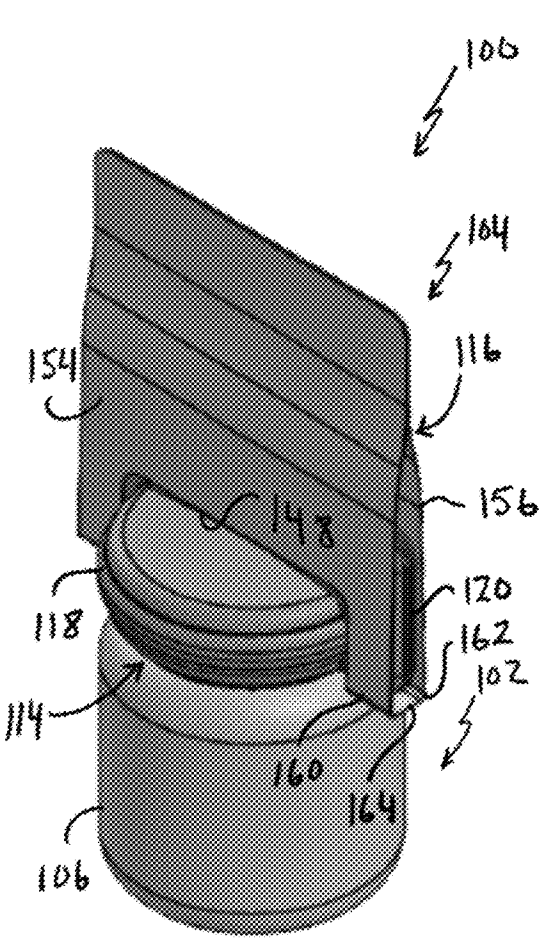
FIG. 14 is a schematic illustration of an example of the card, formed from the blank shown in FIG. 9, coupled to the blister during assembly of the packaged product.

Referring to FIGS. 9 and 14, in one or more examples, the blank 150 includes the first panel 154, a third panel 164 connected to the first panel 154 along a fold line 160, which may be generally straight, and the second panel 156 connected to the third panel 164 along a fold line 162, which may be generally straight and approximately parallel to the fold line 160. In one or more examples, each one of the first panel 154, the second panel 156, and the third panel 164 includes the cutout 152. The cutouts 152 receive (e.g., are configured to receive) the blister body 118. The cutouts 152 are suitably sized to receive the blister body 118 of the blister 114, such that the blister body 118 fits within and extends outward through the cutout 152 and the flange 120 of the blister 114 is sized larger than the cutout 152, thereby enabling the first panel 154 and the second panel 156 to be coupled to the flange 120 to from the card 116 (e.g., as shown in FIG. 14). In one or more examples, the cutout 152 in the first panel 154 is formed along and extends from the fold line 160, the cutout 152 in the second panel 156 is formed along and extends from the fold line 162, and the cutout 152 in the third panel 164 extends between the fold line 160 and the fold line 162 such that the cutouts 152 in the first panel 154, the second panel 156, and the third panel 164 share a common peripheral edge (e.g., form the card opening 148). In one or more examples, during assembly of the product packaging 104, the blank 150 is folded over about the fold line 160 and the fold line 162 and sealed to itself (e.g., the first panel 154 and the second panel 156 are sealed together) such that the flange 120 of the blister 114 is trapped and sealed between the first panel 154 and the second panel 156, the third panel 164 is located under a portion of the flange 120, and the blister body 118 of the blister 114 extends out of the card opening 148 (e.g., as shown in FIG. 14).

Figure 10:
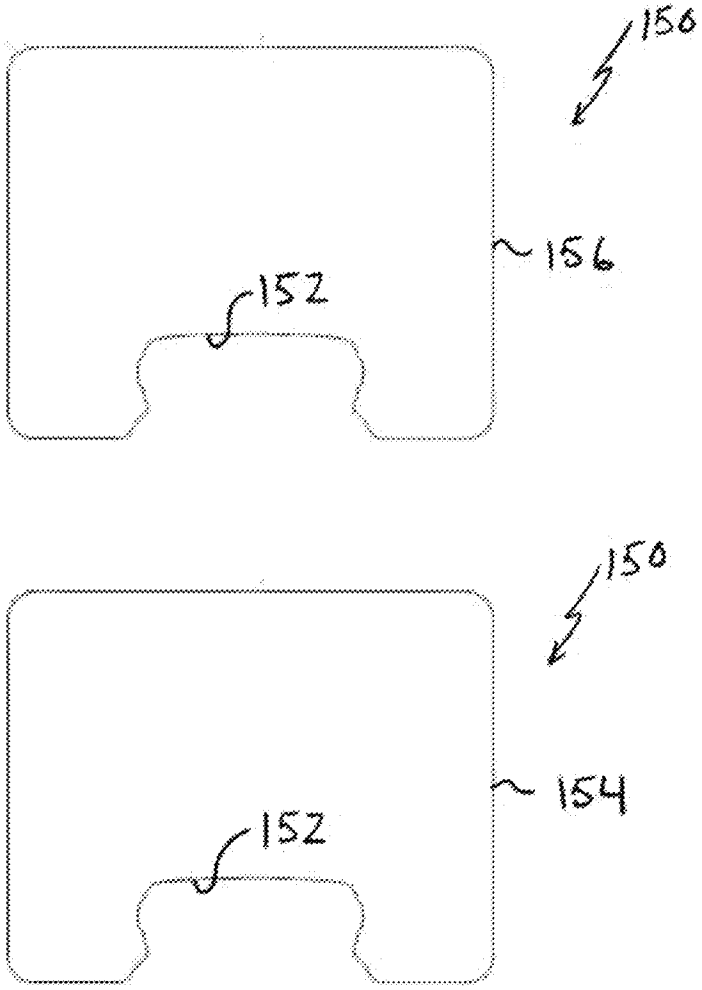
FIG. 10 is a schematic, plan view of an example of a pair of blanks used to form the card of the product packaging.
Figure 15:
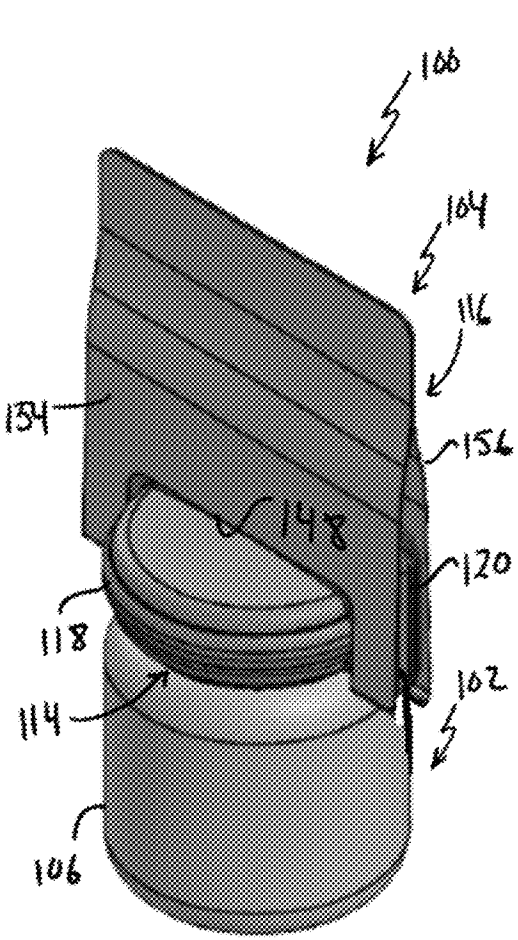
FIG. 15 is a schematic illustration of an example of the card, formed from the pair of blanks shown in FIG. 10, coupled to the blister during assembly of the packaged product.

Referring to FIGS. 10 and 15, in one or more examples, a pair of blanks 150 are used to individually form the first panel 154 and the second panel 156 (e.g., the first panel 154 and the second panel 156 are separate). In one or more examples, each one of the first panel 154 and the second panel 156 includes the cutout 152. The cutouts 152 receive (e.g., are configured to receive) the blister body 118. The cutouts 152 are suitably sized to receive the blister body 118 of the blister 114, such that the blister body 118 fits within and extends outward through the cutout 152 and the flange 120 of the blister 114 is sized larger than the cutout 152, thereby enabling the first panel 154 and the second panel 156 to be coupled to the flange 120 to from the card 116 (e.g., as shown in FIG. 15). In one or more examples, the cutout 152 in the first panel 154 is formed along an edge of the first panel 154 and the cutout 152 in the second panel 156 is formed along an edge of the second panel 156. In one or more examples, the pair of blanks 150 shown in FIG. 10 may be formed by separating the blank 150 shown in FIG. 7 along the fold line 158. In one or more examples, during assembly of the product packaging 104, the pair of blanks 150 is aligned and sealed to each other (e.g., the first panel 154 and the second panel 156 are sealed together) such that the flange 120 of the blister 114 is trapped and sealed between the first panel 154 and the second panel 156 and the blister body 118 of the blister 114 extends out of the card opening 148 (e.g., as shown in FIG. 15).

Generally, the first panel 154 and the second panel 156 have approximately the same size and shape. Similarly, the cutout 152 in the first panel 154 and the cutout 152 in the second panel 156 have approximately the same size and shape and in combination form the card opening 148. In one or more examples, the blank 150 is die cut to form the perimeter edge shape and the cutouts 152.

Any one of the fold lines 158, 160, 162 as well as any other fold lines and/or hinge lines described herein, may include any suitable predefined or preformed line of weakening and/or line of separation known to those skilled in the art and guided by the teachings herein provided, such as a crease, a score, a perforation, relief cut, or the like. Generally, the fold lines transform the blank 150 into a plurality of separate but integrals panels (e.g., first panel 154, second panel 156, third panel 164) that form the card 116. The preformed lines of weakening enable ease in folding during assembly of the card 116 and the product packaging 104.

In one or more examples, the blank 150 and, thus, the card 116 are formed from a sheet material, such as a paperboard substrate. The paperboard substrate may be, for example, a solid bleached sulfate (SBS) substrate, an uncoated natural kraft (UNC) substrate, or a coated natural kraft (CNK) substrate. The paperboard substrate may be formed from virgin fibers, recycled fibers, or combinations thereof.

In one or more examples, the blank 150 and/or the card 116 includes a heat-sealing layer (e.g., a heat-sealable material coating) on a first major side (e.g., the interior surface). The heat-sealing layer enables a heat seal to be created between the first panel 154 and the second panel 156 and a heat seal to be created between the first panel 154, the second panel 156, and the flange 120 of the blister 114. The heat-sealing layer of each one of the first panel 154 and the second panel 156 is sealed (e.g., is configured to be sealed) to the flange 120 of the blister 114 and to each other. The heat-sealing layer may include any suitable material for heat sealing the card 116 to itself and to the flange 120 of the blister 114. Preferably, the material for heat sealing the paperboard structure has a low heat-sealing temperature such that heating of the heat-sealing material does not damage the blister 114. In an example, the heat-sealing layer may include ethylene vinyl acetate (EVA). In another example, the heat-sealing layer may include ethylene methyl acrylate (EMA). In another example, the heat-sealing layer may include ethylene vinyl acetate (EVA) and ethylene methyl acrylate (EMA).

In one or more examples, the heat-sealing layer is pre-provided on the blank 150. Thus, the blank 150 having the heat-sealing layer thereon can be manufactured, packaged, and transported to a facilitate assembly of the product packaging 104, and then the card 116 having the heat-sealing layer thereon can be sealed to the flange 120 of the blister 114 to form the packaged product 100.

The heat-sealing layer may have any suitable coat weight or thickness sufficient for bonding the card 116 to the flange 120 of the blister 114. In an example, the coat weight or thickness is relatively high to ensure bonding of the card 116 to the flange 120 of the blister 114. A relatively high thickness of the heat-sealing layer allows the heat-sealing layer to flow, thereby increasing a bonding surface area. In an example, the heat-sealing layer has a coat weight of at least 5 pounds per 3,000 square feet. In another example, the heat-sealing layer has a coat weight of at least 8 pounds per 3,000 square feet. In another example, the heat-sealing layer has a coat weight of at least 12 pounds per 3,000 square feet. In another example, the heat-sealing layer may have a coat weight of in a range of from 5 pounds per 3,000 square feet to 30 pounds per 3,000 square feet. In another example, the heat-sealing layer may have a coat weight of in a range of from 8 pounds per 3,000 square feet to 30 pounds per 3,000 square feet. In yet another example, the heat-sealing layer may have a coat weight of in a range of from 10 pounds per 3,000 square feet to 30 pounds per 3,000 square feet.

Alternately, other forms of adhesive may be used to seal the card 116 to itself and/or to the flange 120 of the blister 114. For example, the first panel 154, the second panel 156, and the flange 120 may be joined together by heat sealing, RF (radio frequency) sealing, ultrasonic sealing, adhesive, or other means. Such sealing may be done on most of the facing (e.g., interior) surfaces of the first panel 154 and second panel 156 or sealing may be done to less than the entire facing surfaces, for example only around the outer perimeter, and along or upon part or all of the flange 120.

In one or more examples, the card 116 includes graphic displays and/or various product information. For example, the blank 150 and/or the card 116 may include a print layer on a second major side (e.g., the exterior surface). The print layer may provide a suitable surface for printing ink to the second major side to provide for advertising or aesthetic designs thereon. The print layer may be any suitable print layer. For example, the print layer may include clay, calcium carbonate, titanium dioxide, or combinations thereof.

In one or more examples, the blank 150 and/or the card 116 may include a tie layer between the sheet material (e.g., the paperboard substrate) and the heat-sealing layer. The tie layer may have excellent adhesive properties. In an example, the tie layer may be or include low density polyethylene.

In one or more examples, the blank 150 and/or the card 116 may include a tear resistant layer (e.g., a tear resistant material coating) between the sheet material (e.g., the paperboard substrate) and the heat-sealing layer. The tear resistant layer may impart toughness to the card 116. The tear resistant layer may help to improve the tamper-resistance and/or theft-resistance of the product packaging 104. Any suitable tear resistant layer may be used. For example, the tear resistant layer may be or include polyethylene terephthalate. The tear resistant layer may be included in any suitable thickness. For example, the tear resistant layer may have a caliper thickness of about 0.75 mils or more, such as in a range from about 0.75 mils to about 5 mils.

In one or more examples, the blank 150 and/or the card 116 may be coated with materials or may include a material coating that increases the strength of the sheet material (e.g., the paperboard substrate) and/or increases the tear-resistance of the sheet material (e.g., the paperboard substrate).

Figure 16:
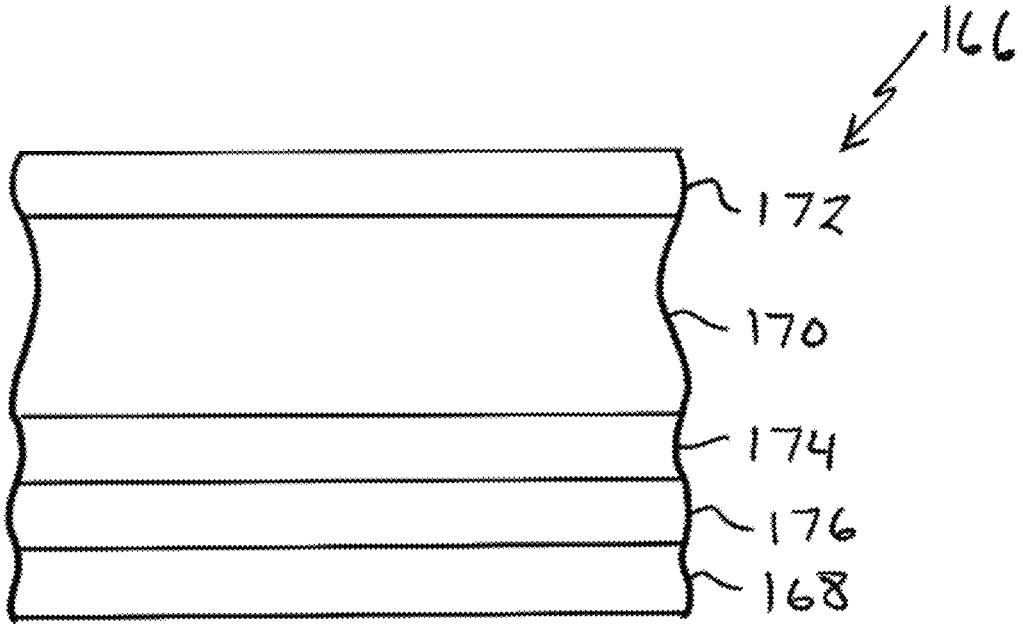
FIG. 16 is a schematic, sectional view of an example of a paperboard structure used to form the card of the product packaging.

Referring now to FIG. 16, which schematically illustrates an example of a paperboard structure 166 used to form the blank 150 and/or the card 116. In one or more examples, the paperboard structure 166 includes a heat-sealing layer 168 on a first major side of a paperboard substrate 170. In one or more examples, the paperboard structure 166 may further include an optional print layer 172 on a second major side of the paperboard substrate 170. In one or more examples, the paperboard structure 166 may still further include an optional tie layer 174 and an optional tear resistant layer 176 between the paperboard substrate 170 and the heat-sealing layer 168.

Figure 11:
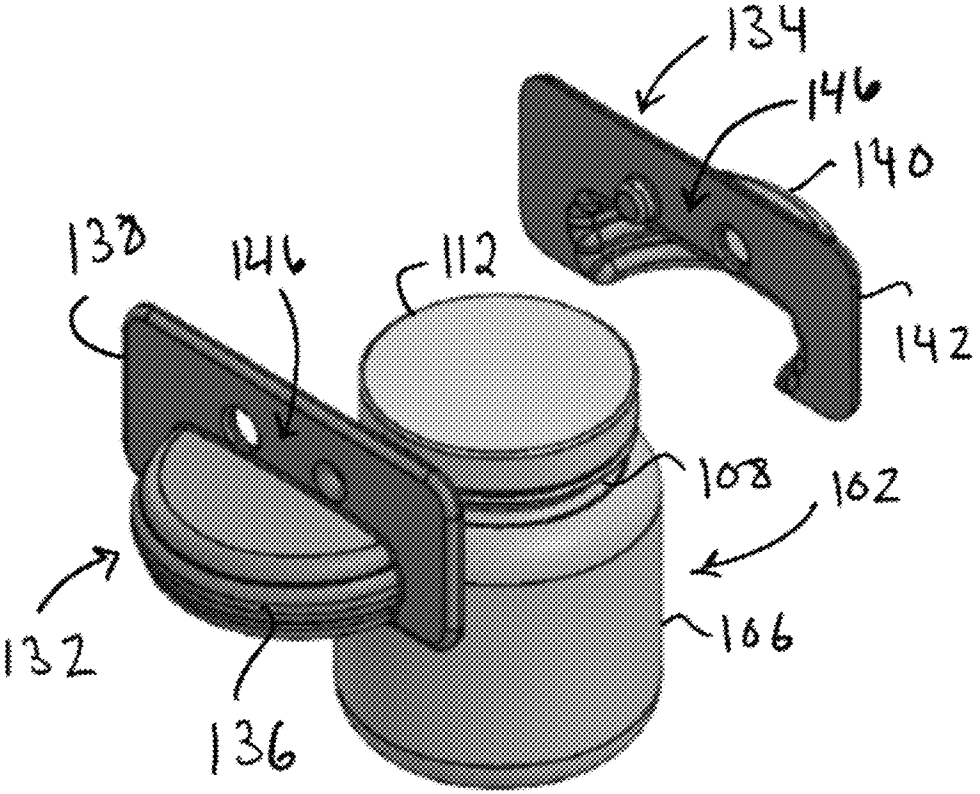
FIG. 11 is a schematic illustration of an example of the blister positioned relative the product container during assembly of the packaged product.
Figure 12:
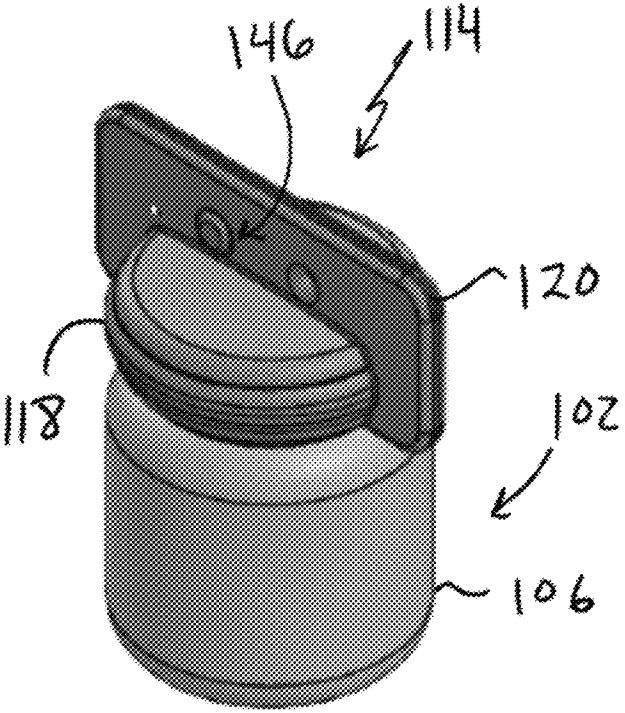
FIG. 12 is a schematic illustration of an example of the blister enclosing a portion of the product container during assembly of the packaged product.
Figure 17:
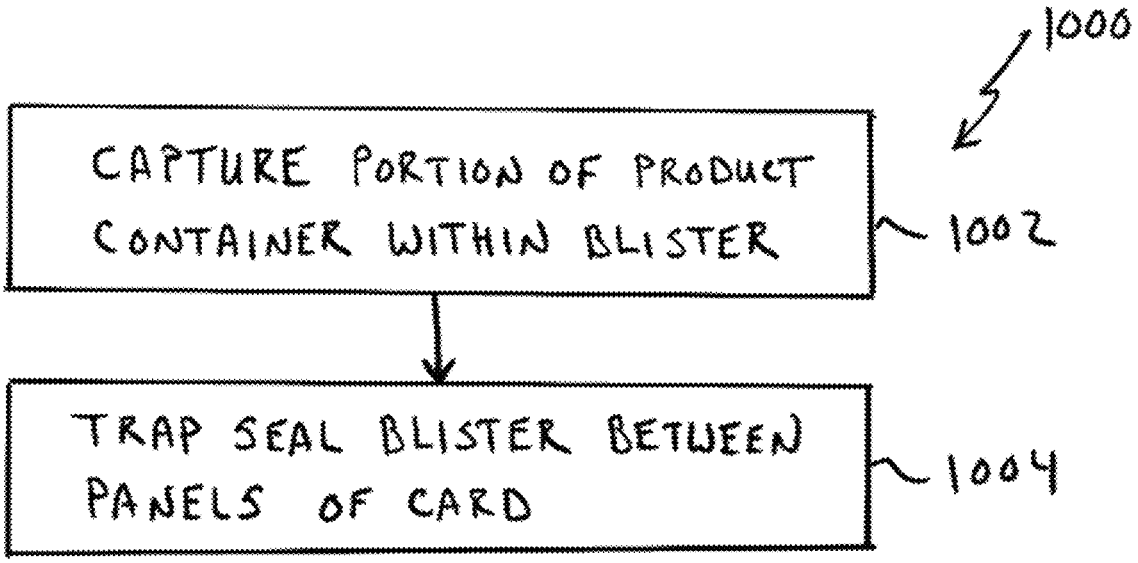
FIG. 17 is a flow diagram of an example of a method of product packaging.

Referring now FIG. 17, by way of examples, the present disclosure is also related to a method 1000 of packaging product. FIGS. 11-15 schematically illustrate example steps in the assembly of the product packaging 104 to form the packaged product 100 (e.g., as shown in FIGS. 13-15). In one or more examples, the method 1000 includes a step of (block 1002) capturing the cap 112 and a portion of the neck 108 of the product container 102 within the blister 114 such that the container body 106 extends from and is located exterior to the blister 114 (e.g., as shown in FIGS. 11 and 12). In one or more examples, the method 1000 includes a step of (block 1004) trap sealing the blister 114 between the first panel 154 and the second panel 156 of the card 116 (e.g., as shown in FIGS. 13-15).

In one or more examples, according to the method 1000, the step of (block 1002) capturing the cap 112 and a portion of the neck 108 of the product container 102 within the blister 114 includes a step of positioning the first blister-portion 132 and the second blister-portion 134 about (e.g., around) the cap 112 and a portion of the neck 108 of the product container 102 (e.g., as shown in FIG. 11) and a step of connected the first blister-portion 132 and the second blister-portion 134 together (e.g., using the retention features 146) to form the blister 114 that encloses the cap 112 and a portion of the neck 108 of the product container 102 such that the container body 106 extends from and is located exterior to the blister 114 (e.g., as shown in FIG. 12). In one or more examples, according to the method 1000, the step of block 1004) trap sealing the blister 114 between the first panel 154 and the second panel 156 of the card 116 includes a step of positioning the first panel 154 and the second panel 156 about the blister 114 such that the flange 120 is sandwiched between the first panel 154 and the second panel 156 and the blister body 118 extends outward from the card opening 148 and a step of sealing the first panel 154 and the second panel 156 of the card 116 to each other and to the flange 120 of the blister 114 (e.g., as shown in FIGS. 13-15).

It will be understood that the illustrated constructions are examples and do not necessarily include all possible constructions. In any of the constructions, the blister 114 may be attached to one panel of the card 116 (e.g., the first panel 154 or the second panel 156) or to both panels (e.g., the first panel 154 and the second panel 156) of the card 116. Generally, the packaged product 100 as described herein may be closed and sealed once a portion of the product container is placed inside and enclosed by the blister 114. Once captured, the blister 114 may be placed into the card 116 and the flange 120 sandwiched between the two panels of the card 116. The material layers (e.g., first panel 154, flange 120, and second panel 156) may then be joined together by heat sealing, adhesive, staples, or other suitable method.

Generally, the disclosed method 1000 may be performed using any suitable assembly technique or process. Advantageously, the method 1000 may be performed using existing pack-out processes for conventional trapped blister packaging.

The preceding detailed description refers to the accompanying drawings, which illustrate specific examples of the disclosed product packaging, packaged product, and method described by the present disclosure. It will be understood that the disclosed examples are merely exemplary embodiments of the way in which certain aspects of the of the disclosed product packaging, packaged product, and method can be implemented and do not represent an exhaustive list of all of the ways the of the disclosed product packaging, packaged product, and method may be embodied. Other examples having different structures and operations do not depart from the scope of the present disclosure. Like reference numerals may refer to the same feature, element, or component in the different drawings. The figures are not necessarily to scale and some features may be exaggerated or minimized to show details of particular components. Throughout the present disclosure, any one of a plurality of items may be referred to individually as the item and a plurality of items may be referred to collectively as the items. Moreover, as used herein, a feature, element, component or step preceded with the word "a" or "an" should be understood as not excluding a plurality of features, elements, components or steps, unless such exclusion is explicitly recited.

Illustrative, non-exhaustive examples, which may be, but are not necessarily, claimed, of the subject matter according to the present disclosure are provided above. Reference herein to "example" means that one or more feature, structure, element, component, characteristic, and/or operational step described in connection with the example is included in at least one aspect, embodiment, and/or implementation of the subject matter according to the present disclosure. Thus, the phrases "an example," "another example," "one or more examples," and similar language throughout the present disclosure may, but do not necessarily, refer to the same example. Further, the subject matter characterizing any one example may, but does not necessarily, include the subject matter characterizing any other example. Moreover, the subject matter characterizing any one example may be, but is not necessarily, combined with the subject matter characterizing any other example.

It is to be understood that not necessarily all objects or advantages may be achieved in accordance with any particular example described herein. Thus, for example, those skilled in the art will recognize that certain examples may be configured to operate in a manner that achieves or optimizes one advantage or group of advantages as taught herein without necessarily achieving other objects or advantages as may be taught or suggested herein.

It should be appreciated that, when used to modify a structure, an element, an item, a component or a feature described herein, the terms "front," "rear," "bottom," "top," "left," "right," "side," "end," as well as similar terms or other forms of such terms, are relative and refer to an example of a spatial relationship between structures, elements, items, components or features. As such, examples of the packaged product 100 and the product packaging 104, described herein and illustrated in the figures, are not intended to be limited by the specific relative terms used to describe any structure, element, item, component or feature of the packaged product 100 or the product packaging 104.

Conditional language such as, among others, "can" or "may," unless specifically stated otherwise, are otherwise understood within the context as used in general to convey that certain examples include, while other examples do not include, certain features, elements and/or steps. Thus, such conditional language is not generally intended to imply that features, elements and/or steps are in any way required for one or more examples or that one or more examples necessarily include logic for deciding, with or without user input or prompting, whether these features, elements and/or steps are included or are to be performed in any particular example.

Unless otherwise indicated, the terms "first," "second," "third," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Those skilled in the art will appreciate that not all elements described and illustrated in FIGS. 1-16 need be included in every example and not all elements described herein are necessarily depicted in each illustrative example. Unless otherwise explicitly stated, the schematic illustrations of the examples depicted in FIGS. 1-16 are not meant to imply structural limitations with respect to the illustrative example. Rather, although one illustrative structure is indicated, it is to be understood that the structure may be modified when appropriate. Additionally, modifications, additions and/or omissions may be made to the illustrated structure.

Further, references throughout the present specification to features, advantages, or similar language used herein do not imply that all of the features and advantages that may be realized with the examples disclosed herein should be, or are in, any single example. Rather, language referring to the features and advantages is understood to mean that a specific feature, advantage, or characteristic described in connection with an example is included in at least one example. Thus, discussion of features, advantages, and similar language used throughout the present disclosure may, but do not necessarily, refer to the same example.

The described features, advantages, and characteristics of one example may be combined in any suitable manner in one or more other examples. One skilled in the relevant art will recognize that the examples described herein may be practiced without one or more of the specific features or advantages of a particular example. In other instances, additional features and advantages may be recognized in certain examples that may not be present in all examples. Furthermore, although various examples of the packaged product 100, the product packaging 104, and the method 1000 have been shown and described, modifications may occur to those skilled in the art upon reading the specification. The present application includes such modifications and is limited only by the scope of the claims.

What is claimed is:

1. Product packaging comprising: a blister configured to capture a cap and a portion of a neck of a product container, wherein the blister comprises a blister body that forms a container-receiving cavity and a flange extending from the blister body; wherein the blister comprises: a first blister-portion comprising a first blister-body-portion and a first flange-portion; and a second blister-portion comprising a second blister-body-portion and a second flange-portion: and the first blister-portion and the second blister-portion are configured to mate with each other such that the first blister-body-portion captures a first portion of the cap and the neck and the second blister-body-portion captures a second portion of the cap and the neck;

and a card coupled to the blister, wherein the card comprises; a first panel; a second panel coupled to the first panel; a card opening; the first flange-portion and the second flange-portion are sandwiched between the first panel and the second panel;

and the first blister-body-portion and the second blister-body-portion extend through the card opening.

2. The product packaging of claim 1, wherein the blister is made of a bio-based material.

3. The product packaging of claim 2, wherein the bio-based material comprises a cellulose-based material and a starch-based material.

4. The product packaging of claim 2, wherein the blister is injection molded.

5. The product packaging of claim 1, wherein: the card comprises: a paperboard substrate; and a heat-sealing layer on a first major side of the paperboard substrate; and the heat-sealing layer is sealed to the flange of the blister.

6. The product packaging of claim 1, wherein the blister body comprises: a top wall; a circumrenal sidewall extending from the top wall; and a lip extending radially inward from the sidewall.

7. The product packaging of claim 1, wherein the blister further comprises a retention feature configured to couple the first flange-portion and the second flange-portion together.

8. The product packaging of claim 1, wherein the flange extends approximately perpendicularly outward from the blister body.

9. A packaged product comprising:

a product container comprising: a body configured to contain product;

a neck extending from the body; and a cap removably coupled to the neck; and product packaging comprising:

a blister that captures the cap and a portion of the neck of the product container wherein the blister comprises a blister body that forms a container-receiving cavity and a flange extending from the blister body, wherein the blister comprises: a first blister-portion comprising a first blister-body-portion and a first flange-portion; and a second blister-portion comprising a second blister-body-portion and a second flange-portion; and the first blister-portion and the second blister-portion are configured to mate with each other such that the first blister-body-portion captures a first portion of the cap and the neck and the second blister-body-portion captures a second portion of the cap and the neck; and a card coupled to the blister, wherein: the card comprises: a first panel: a second panel coupled to the first panel; and a card opening; the first flange-portion and the second flange-portion are sandwiched between the first panel and the second panel; and the first blister-body-portion and the second blister-body-portion extend through the card opening.

10. The packaged product of claim 9, wherein the blister is made of a molded bio-based material.

11. The packaged product of claim 10, wherein the bio-based material comprises a cellulose-based material and a starch-based material.

12. The packaged product of claim 9, wherein: the card comprises: a paperboard substrate; and a heat-sealing layer on a first major side of the paperboard substrate; and the heat-sealing layer is sealed to the flange of the blister.

13. The packaged product of claim 9, wherein the blister body comprises: a top wall; a circumrenal sidewall extending from the top wall and circumscribing the cap of the product container; and a lip extending radially inward from the sidewall toward the neck of the product container.

14. The packaged product of claim 9, wherein the blister further comprises a retention feature configured to couple the first flange-portion and the second flange-portion together.

15. The packaged product of claim 9, wherein flange extends approximately perpendicularly outward from the blister body.

* * * * *